US006097312A

United States Patent [19]

Tanji et al.

[11] Patent Number: 6,097,312

[45] Date of Patent: Aug. 1, 2000

[54] METHOD AND APPARATUS FOR DETECTING MAGNETOSTRICTIVE RESONATOR AND TRAFFIC SYSTEM

[75] Inventors: Yoshihiko Tanji; Toshihiro Yoshioka, both of Osaka; Keiji Yasui, Hyogo, all of Japan

[73] Assignee: Matsushita Electric Industrial Co., Ltd., Osaka, Japan

[21] Appl. No.: 09/201,285

[22] Filed: Nov. 30, 1998

[30] Foreign Application Priority Data

Nov. 28, 1997 [JP] Japan ..... 9-327402
Nov. 28, 1997 [JP] Japan ..... 9-327768

[51] Int. Cl.[7] ..... G08G 1/09

[52] U.S. Cl. ..... 340/905; 340/933; 340/939

[58] Field of Search ..... 340/435, 436, 340/933, 939, 905

[56] References Cited

U.S. PATENT DOCUMENTS 4,067,235 1/1978 Markland et al. ..... 73/146.5
5,491,475 2/1996 Rouse et al. ..... 340/939
5,767,766 6/1998 Kwun ..... 340/436

*Primary Examiner*—Edward Lefkowitz
*Attorney, Agent, or Firm*—Ratner & Prestia

[57] ABSTRACT

While transmitting an electromagnetic wave from a transmitting antenna to, for example, a magnetostrictive resonator, buried in a road, a reception section composed of a reception amplifier and signal processor is inactivated. After stopping transmission of the electromagnetic wave, the reception section is activated and a receiving antenna detects an electromagnetic wave radiated by the magnetostrictive resonator. In this method, a magnetostrictive resonator detection apparatus having a sufficient directivity and detection distance can be presented. The magnetostrictive resonator detection apparatus applying this detecting method is mounted aboard a vehicle, and a plurality of magnetostrictive resonators are buried in the road. By sequentially transmitting and receiving electromagnetic waves at different resonance frequencies thereof, and judging the configuration of the road and the vehicle, a safe traffic system is presented.

21 Claims, 10 Drawing Sheets

1 : Magnetorestrictive resonator
5 : transmitting antenna
8 : receiving antenna
14 : Road 1a: Magnetostrictive resonator for central marker
1b: Magnetostrictive resonator for up road side marker
1c: Magnetostrictive resonator for down road side marker
5: transmitting antenna
8: receiving antenna
14: Road
15: Vehicle 1a: Magnetostrictive resonator for central marker
1b: Magnetostrictive resonator for up road side marker
1c: Magnetostrictive resonator for down road side marker
5: transmitting antenna
8: receiving antenna
6: Transmission side tuning capacitor
7: Transmission side discharge resistor
9: Reception side tuning capacitor
10: Reception side discharge resistor 1a: Magnetostrictive resonator for central marker
1b: Magnetostrictive resonator for up road side marker
1c: Magnetostrictive resonator for down road side marker
5: transmitting antenna
8: receiving antenna
6: Transmission side tuning capacitor
7: Transmission side discharge resistor
9: Reception side tuning capacitor
10: Reception side discharge resistor 1a: Magnetostrictive resonator for central marker
1b: Magnetostrictive resonator for up road side marker
1c: Magnetostrictive resonator for down road side marker
5: transmitting antenna
8: receiving antenna
6: Transmission side tuning capacitor
7: Transmission side discharge resistor
9: Reception side tuning capacitor
10: Reception side discharge resistor 1a: Magnetostrictive resonator for central marker
1b: Magnetostrictive resonator for up road side marker
1c: Magnetostrictive resonator for down road side marker
5: transmitting antenna
8: receiving antenna
6: Transmission side tuning capacitor
7: Transmission side discharge resistor
9: Reception side tuning capacitor
10: Reception side discharge resistor 1d: Magnetorestrictive resonator for up road side marker
1e: Magnetorestrictive resonator for down road side marker
5: transmitting antenna
8: receiving antenna
14: Road
15: Vehicle

METHOD AND APPARATUS FOR DETECTING MAGNETOSTRICTIVE RESONATOR AND TRAFFIC SYSTEM

FIELD OF THE INVENTION

The present invention relates to a magnetostrictive resonator detecting method for detecting the presence of a magnetostrictive resonator, and a magnetostrictive resonator detection apparatus employing the magnetostrictive resonator detecting method, and also to a traffic system for controlling flow of vehicles by detecting the position of magnetostrictive resonator buried in a road, or detecting the road information assigned to the road by a magnetostrictive resonator detection apparatus mounted aboard a vehicle.

BACKGROUND OF THE INVENTION

Hitherto, road information such as lane information and curve information on the road was represented by lane marks for distinguishing the lanes, road signs and others, and was visually recognized by the vehicle drivers.

In visual recognition of lane marks and signs, however, it was hard to obtain the road information accurately for the vehicle drivers when driving in bad weather, driving at night, or driving in a tunnel, and hence the safety was impeded. Accordingly, it has been attempted to run by giving road information by means of various markers and the like.

As one of such examples, recently, by burying a magnetic material in the road as a road marker, the marker is detected by a detector mounted aboard a vehicle, and the position of the vehicle on the road is detected, and it is attempted to allow the vehicle to run.

In this case, the magnetic flux density in the horizontal and vertical direction from the magnetic material marker buried in the road was detected by mounting a magnetic sensor on the vehicle. Usually, the marker of magnetic material is a magnet. Hence, the detector by the magnetic sensor is hard to keep balance between the directivity and detecting distance. When the detecting distance is long, a magnet of strong magnetic force and large size is needed and it is not economical. Besides, a magnet having a strong attracting force may attract iron particles or cans scattered about on the road.

In a related art, ferrite and ferromagnetic amorphous materials are known to induce dimensional changes called Joule effect due to application of external magnetic field (called magnetostrictive phenomenon). At retail stores, by adhering the magnetostrictive resonator having such property to the merchandise, the magnetostrictive resonator detection apparatus is installed at the entrance and exit of the store, and illegal take-out of merchandise is prevented.

When an alternating-current magnetic field or electric field is applied to the magnetostrictive resonator by electromagnetic wave, an electromagnetic wave having a specific phase difference from the applied (call) electromagnetic wave is radiated from the magnetostrictive resonator. So far, the presence of the magnetostrictive resonator was sensed by detecting the phase difference between the call electromagnetic wave and the electromagnetic wave radiated from the magnetostrictive resonator.

In the conventional method of detecting phase difference, as compared with the transmission output level of the called electromagnetic wave, the input level of electromagnetic wave radiated from the magnetostrictive resonator is very small. It was hence difficult to detect the input phase by reference to the output phase. Usually, the ratio of signal level of transmission output to input is about one-millionth. Or, the reception section may be saturated by transmission output, and it was hard to detect a feeble input signal, as compared with transmission output. In this detecting method, therefore, in order to apply to a road traffic system, it was not easy to obtain the detecting distance and directivity, and there were problems in the aspect of practical use.

SUMMARY OF THE INVENTION

It is hence an object of the invention to present a magnetostrictive resonator detection apparatus and a traffic system solving these problems of the prior art.

It is an object of the magnetostrictive resonator detection apparatus (hereinafter called MRDA) of the invention is to detect the presence of magnetostrictive resonator by transmitting a call electromagnetic wave to the magnetostrictive resonator for inducing an intrinsic mechanical resonance, exciting the magnetostrictive resonator in a resonant state, stopping the call electromagnetic wave, and measuring the electromagnetic wave radiated from the excited magnetostrictive resonator.

The magnetostrictive resonator continues the mechanical resonance for a short while after stopping the call electromagnetic wave, and hence continues to radiate the electromagnetic wave by the magnetostrictive change in this period. Therefore, by measuring the frequency of this electromagnetic wave, the MRDA can specify the magnetostrictive resonator without knowing the phase difference from the transmitted electromagnetic wave.

That is, the invention relates to the MRDA capable of detecting without having bad effects of transmitted electromagnetic wave.

Moreover, by burying a magnetostrictive resonator in a road and detecting its presence by the MRDA of the invention, it is an object to present a safe and sophisticated traffic system, and also to present a traffic system allowing automatic running.

To achieve the objects, the detecting method of magnetostrictive resonator of the invention is a method of detecting the electromagnetic wave radiated by the magnetostrictive resonator resonating mechanically, by making the reception section inactive while transmitting the electromagnetic wave at a frequency for generating an intrinsic mechanical resonance in the magnetostrictive resonator, and making the reception section active after stopping transmission of the electromagnetic wave.

To achieve the objects, a first MRDA of the invention comprises a transmission section for transmitting an electromagnetic wave at a frequency for generating an intrinsic mechanical resonance in the magnetostrictive resonator, a circuit having a function of making the reception section inactive while the transmission section is transmitting the electromagnetic wave, and a signal processor for processing the signal for detecting the electromagnetic wave radiated by the magnetostrictive resonator resonating mechanically after stopping transmission of electromagnetic wave.

A second MRDA of the invention relates to the first MRDA of the invention, in which the reception section includes a signal processor for measuring the frequency of the electromagnetic wave radiated from the received magnetostrictive resonator.

A third MRDA of the invention relates to the first MRDA of the invention, in which the reception section includes a waveform shaper of electromagnetic wave radiated from the received magnetostrictive resonator and a counter, and the magnetostrictive resonator measures the frequency by counting the number of cycles of the electromagnetic wave radiated in every unit time.

A fourth MRDA of the invention relates to the first MRDA of the invention, in which the reception section includes a waveform shaper of electromagnetic wave radiated from the received magnetostrictive resonator and a frequency-voltage converter, and the magnetostrictive resonator measures the electromagnetic wave radiated in unit time by converting from frequency to voltage.

A fifth MRDA of the invention relates to the first to fourth MRDA of the invention, further comprising a discharge resistance between the transmission frequency source oscillator and transmitting antenna for delivering electromagnetic wave in the air, in which the discharge resistance is made active when changing over from transmission to reception.

A sixth MRDA of the invention relates to the first to fifth MRDA of the invention, in which the transmission section includes an oscillator for transmitting electromagnetic waves at plural frequencies, and also a reception section for receiving plural frequencies corresponding to transmission frequencies.

A seventh MRDA of the invention relates to the first to sixth MRDA of the invention, further comprising a transmission tuning capacitor at every mutually different resonance frequency transmitted to the transmission section, and a function for selecting the transmission tuning capacitor depending on the oscillated resonance frequency. Moreover, the reception section includes a reception tuning capacitor at every mutually different resonance frequency received corresponding to the transmission frequencies, and a function for selecting the reception tuning capacity according to the received resonance frequency.

An eighth MRDA of the invention relates to the first to seventh MRDA of the invention, in which after transmitting and receiving electromagnetic wave of one resonance frequency out of the mutually different resonance frequencies, the electromagnetic wave of different resonance frequency from the one resonance frequency is transmitted and received sequentially.

A ninth MRDA of the invention relates to the first to eighth MRDA of the invention, further comprising a display unit for specifying the magnetostrictive resonator and displaying its detection level by a bar graph.

In a first traffic system of the invention, the road has the magnetostrictive resonator, and the vehicle has the first to ninth MRDA of the invention.

In a second traffic system of the invention, magnetostrictive resonators having road information assigned with mutually different resonance frequencies are continuously buried in a road at specific intervals at every resonance frequency.

In a third traffic system of the invention, the vehicle runs automatically by detecting the magnetostrictive resonator.

In a fourth traffic system of the invention, magnetostrictive resonators are buried in a road.

In a fifth traffic system of the invention, a display unit for displaying the road and vehicle is provided so as to display the vehicle position on the road.

DESCRIPTION OF THE PREFERRED EMBODIMENTS

Figure 1B:
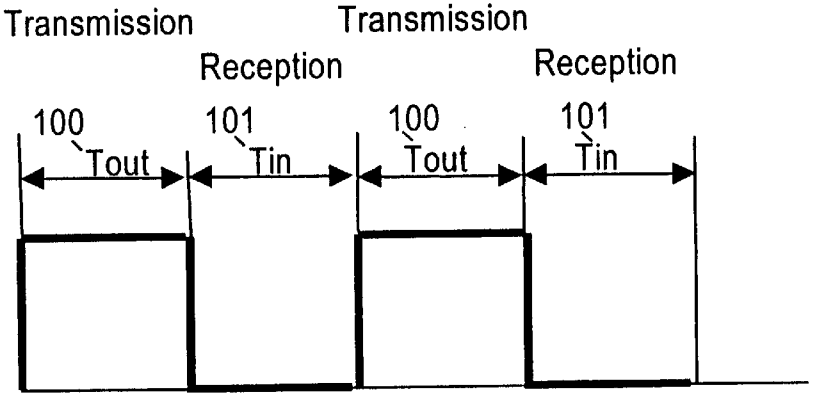
FIG. 1B is a diagram showing transmission and reception timing.

The magnetostrictive resonator is composed of ferrite or ferromagnetic amorphous material, and makes use of the property to induce dimensional change called Joule effect by applying an external magnetic field (known as magnetostrictive phenomenon). Generally, when an alternating-current electric field or alternating-current magnetic field at a specified frequency for generating mechanical resonance is applied to a magnetostrictive resonator in plate or bar form provided with a magnetic bias to cause vibration in its longitudinal direction, the magnetostrictive resonator reaches the maximum resonance amplitude at resonance frequency to induce an alternating-current magnetization, and electromagnetic waves are radiated. At the same time, this vibration is in mechanical resonant state even if the alternating-current electric or magnetic field is removed, and electromagnetic waves are radiated for a short time.

The MRDA of the invention is intended to detect the presence of magnetostrictive resonator by transmitting a call electromagnetic wave for inducing an intrinsic mechanical resonance to the magnetostrictive resonator to excite the magnetostrictive resonator in resonant state, stopping transmission of the call electromagnetic wave, and measuring the electromagnetic wave radiated from the magnetostrictive resonator.

The magnetostrictive resonator maintains its mechanical resonance for a short time after stopping the call electromagnetic wave, and continues to radiate electromagnetic waves by magnetostrictive changes in this period. Therefore, by measuring the electromagnetic waves, the magnetostrictive resonator can be identified without knowing the phase difference from the transmitted electromagnetic waves.

Moreover, while the transmission section is sending electromagnetic waves, the reception section waits in inactive state, and therefore the reception section does not receive the transmitted electromagnetic waves to be in saturated state, and when changed over from transmission to reception, it is immediately put in receiving state, so that the presence of the magnetostrictive resonator can be detected securely when receiving. In other words, it is possible to detect without having effects of the transmitted electromagnetic waves. If the transmission output is large, the reception section is not saturated.

An embodiment of the invention is described below by referring to the drawings.

Figure 1C:
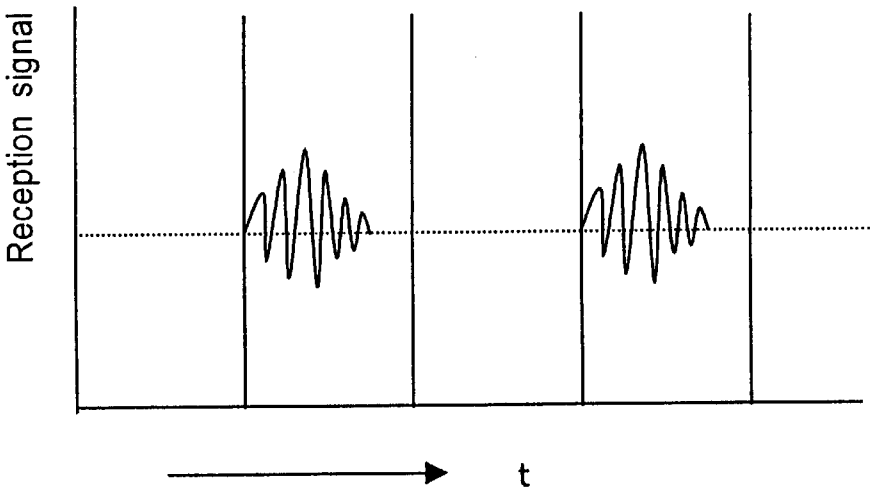
FIG. 1C is a diagram showing detection signal detected by the same apparatus.
Figure 1A:
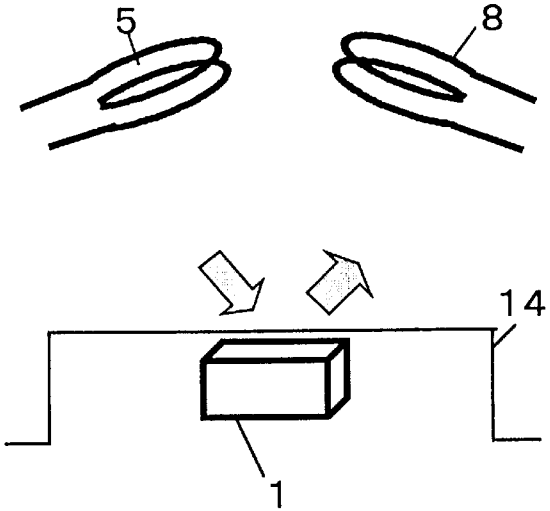
FIG. 1A is a diagram showing a principle of detection of magnetostrictive resonator detection apparatus in an embodiment of the invention.

FIG. 1A is a diagram showing the principle of detecting method of detecting the presence of magnetostrictive resonator 1 buried in a road 14 according to the invention. FIG. 1B is a diagram showing the timing of transmission of electromagnetic wave and reception of electromagnetic wave radiated by the magnetostrictive resonator in the same detecting method, in which the transmission period is Tout 100 and reception period is Tin 101. While transmitting electromagnetic waves for period Tout 100, the reception section is set in inactive state, and after termination of transmission, the reception section is active for the period of Tin 101 when receiving the electromagnetic waves radiated from the magnetostrictive resonator. That is, it shows that reception starts after stopping transmission. FIG. 1C is a diagram showing detection signal to be detected by the apparatus. In FIGS. 1A, 1B and 1C, an electromagnetic wave at resonance frequency is transmitted for a short time from a transmitting antenna 5, and a magnetostrictive resonator 1 is put in resonant state. Stopping the transmission, consequently, the electromagnetic wave radiated from the magnetostrictive resonator in resonant state is detected by a receiving antenna 8. In this invention, it is not necessary to detect particularly the phase difference from the transmitted electromagnetic wave, and it is hence a feature thereof that the magnetostrictive resonator can be identified without resort to transmission signal. Moreover, since the magnetostrictive resonator can be detected without having effects of transmission electromagnetic wave, sufficient detection distance and directivity for car-mount use are obtained.

Figure 2:
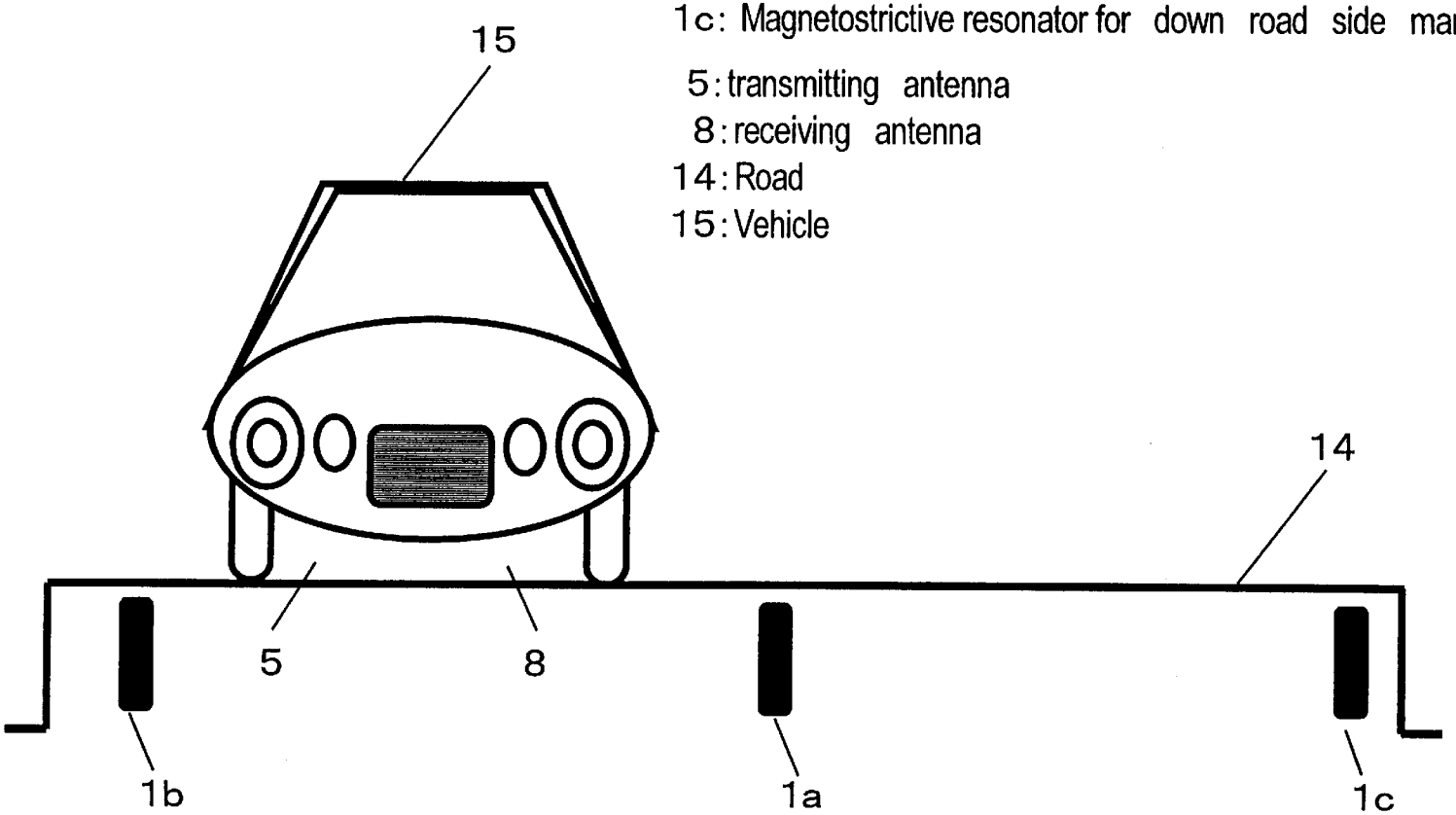
FIG. 2 is a diagram showing an example of display of the configuration of road and vehicle in the same apparatus.

FIG. 2 is a drawing showing an example of application of the MRDA of the invention in a traffic system, describing a configuration in which a vehicle 15 is provided with a transmitting antenna 5 and a receiving antenna 8, and magnetostrictive resonators 1*a*, 1*b*, 1*c* for each marker are buried in a road 14. For example, magnetostrictive resonators 1*a* is specified for central marker, magnetostrictive resonators 1*b* is specified for up road side marker and magnetostrictive resonators 1*c* is specified for down road side marker.

Figure 3:
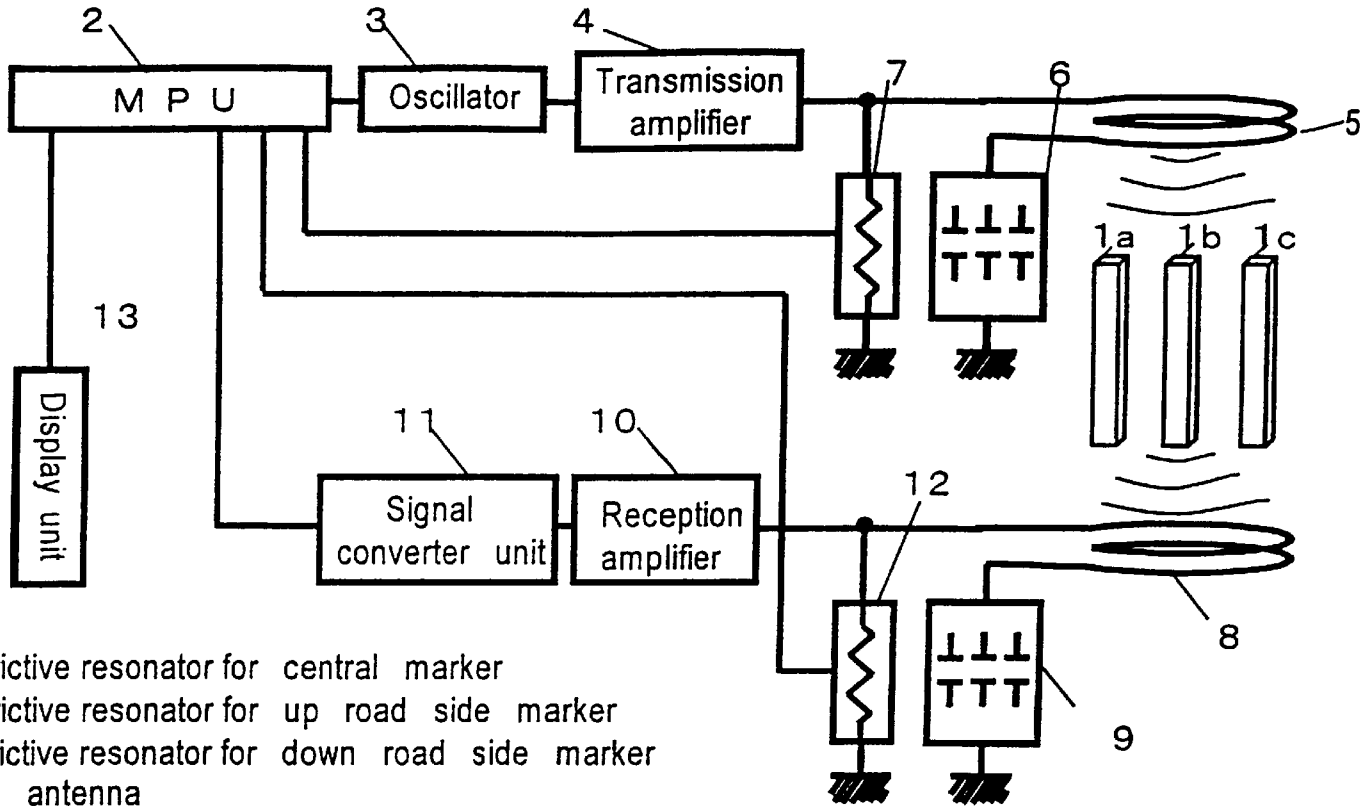
FIG. 3 is a block diagram of a first magnetostrictive resonator detection apparatus of the invention.

FIG. 3 is a block diagram of MRDA in an embodiment of the invention. In FIG. 3, reference numeral 2 is a microprocessing unit (hereinafter called MPU) responsible for control of the MRDA, 3 is an oscillator capable of transmitting plural resonance frequencies to plural magnetostrictive resonators, 4 is a transmission amplifier, 5 is a transmitting antenna, 6 is a transmission tuning capacitor unit for selecting an optimum capacitor depending on the transmitted resonance frequency, 7 is a discharge resistance connected between the transmission frequency output unit composed of oscillator 3, transmission amplifier 4 and others, and the transmitting antenna 5 for emitting electromagnetic waves in the air, to be activated for a short time after completion of transmission (when changing over from transmission to reception), 8 is an antenna for receiving the electromagnetic wave radiated from the magnetostrictive resonator, 9 is a reception tuning capacitor unit for selecting an optimum capacitor depending on the received resonance frequency, 10 is a reception signal amplifier, and 11 is a signal converter unit for converting the signal amplified by the reception signal amplifier 10. The output of this signal converter unit 11 is delivered to the MPU 2, and is operated for detection of magnetostrictive resonator. Reference numeral 12 is a discharge resistance connected between the receiving antenna 8 and reception signal amplifier 10, being changed over between active state during transmission period and inactive state during reception period. Reference numeral 13 is a display unit for displaying the result operated in the MPU 2.

In FIG. 3, meanwhile, reference numerals 1*a*, 1*b*, 1*c* denote magnetostrictive resonators shown in FIG. 2.

Figure 4:
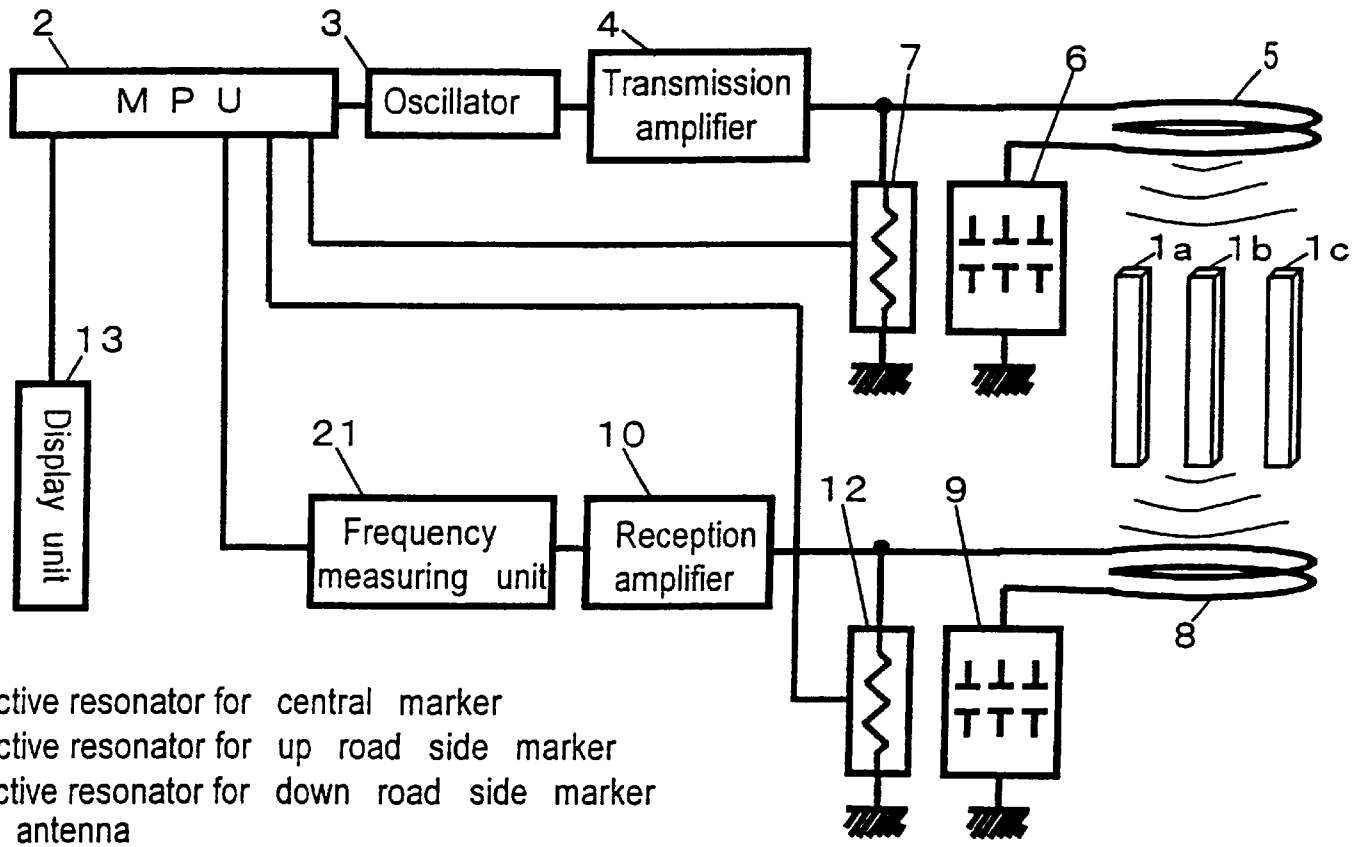
FIG. 4 is a block diagram of first signal processing of reception section of the same magnetostrictive resonator detection apparatus.

FIG. 4 is a block diagram of MRDA showing a first specific constitution of the signal converter 11 shown in FIG. 3. In FIG. 4, same constituent parts as in FIG. 3 are identified with same reference numerals and duplicate explanation is omitted. Reference numeral 21 is a unit for receiving the electromagnetic wave radiated from the magnetostrictive resonator by the receiving antenna 8, and measuring the frequency of the output of this signal being amplified in the reception amplifier 10, and it is intended to measure the frequency of electromagnetic wave received at the logic signal level.

In this constitution, a call electromagnetic wave is transmitted from the transmitting antenna 5 to set, for example, the magnetostrictive resonator 1*a* in resonant state, and after stopping the call electromagnetic wave, the frequency of the electromagnetic wave radiated by the resonance of the magnetostrictive resonator 1*a* is measured, and presence or absence of the magnetostrictive resonator 1*a* is detected.

Figure 5:
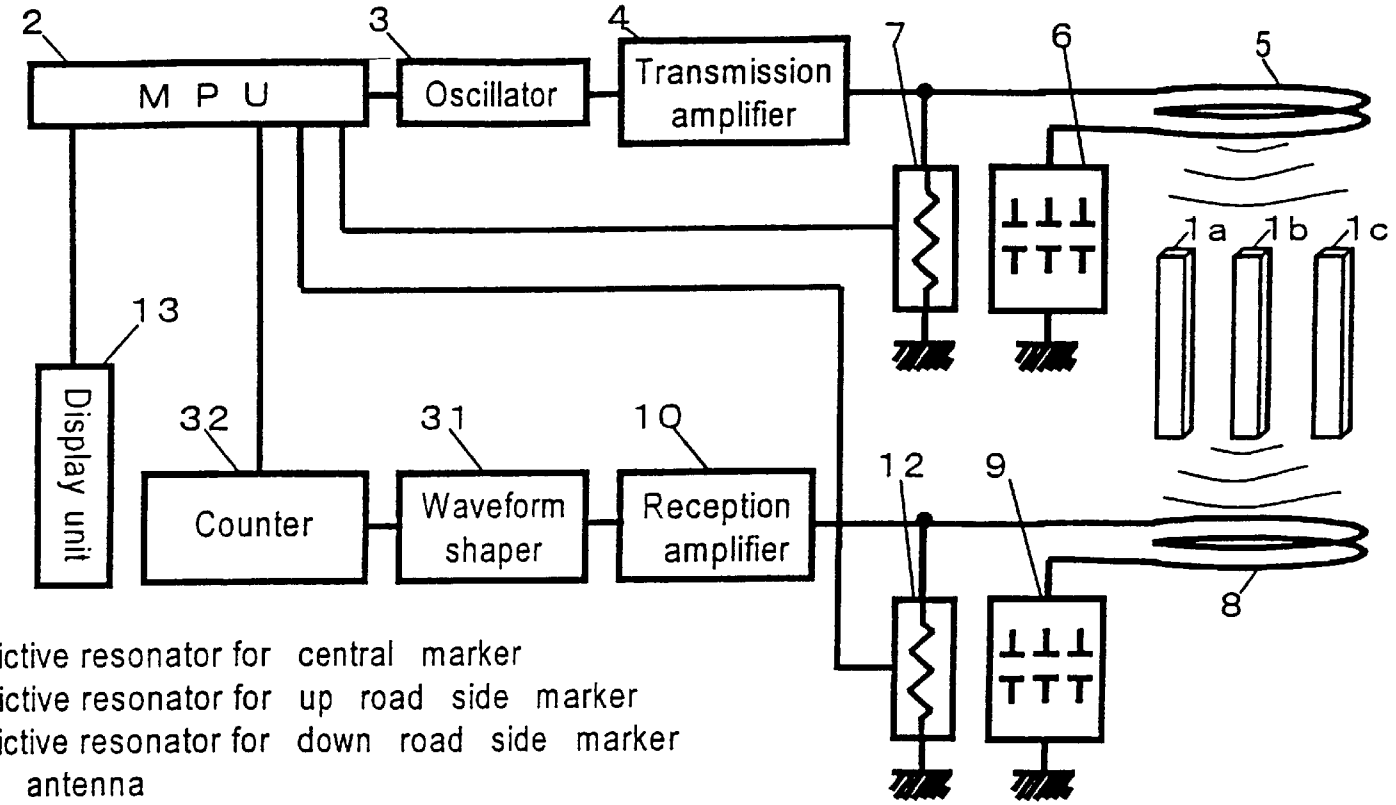
FIG. 5 is a block diagram of second signal processing of reception section of the same magnetostrictive resonator detection apparatus.

FIG. 5 is a block diagram of MRDA showing a second specific constitution of the signal converter 11 shown in FIG. 3. In FIG. 5, same constituent parts as in FIG. 3 are identified with same reference numerals and duplicate explanation is omitted. Reference numeral 31 is a waveform shaper for receiving the electromagnetic wave radiated from the magnetostrictive resonator by the receiving antenna 8 and shaping the waveform of the output of the signal being amplified in the reception amplifier 10, and it shapes into a rectangular waveform. Reference numeral 32 is a counter which counts the number of reception signals in rectangular waveform.

In this constitution, counting the number of reception signals in each unit time, the magnetostrictive resonator, for example, 1*a* is detected by the presence or absence of resonance frequency.

Figure 6:
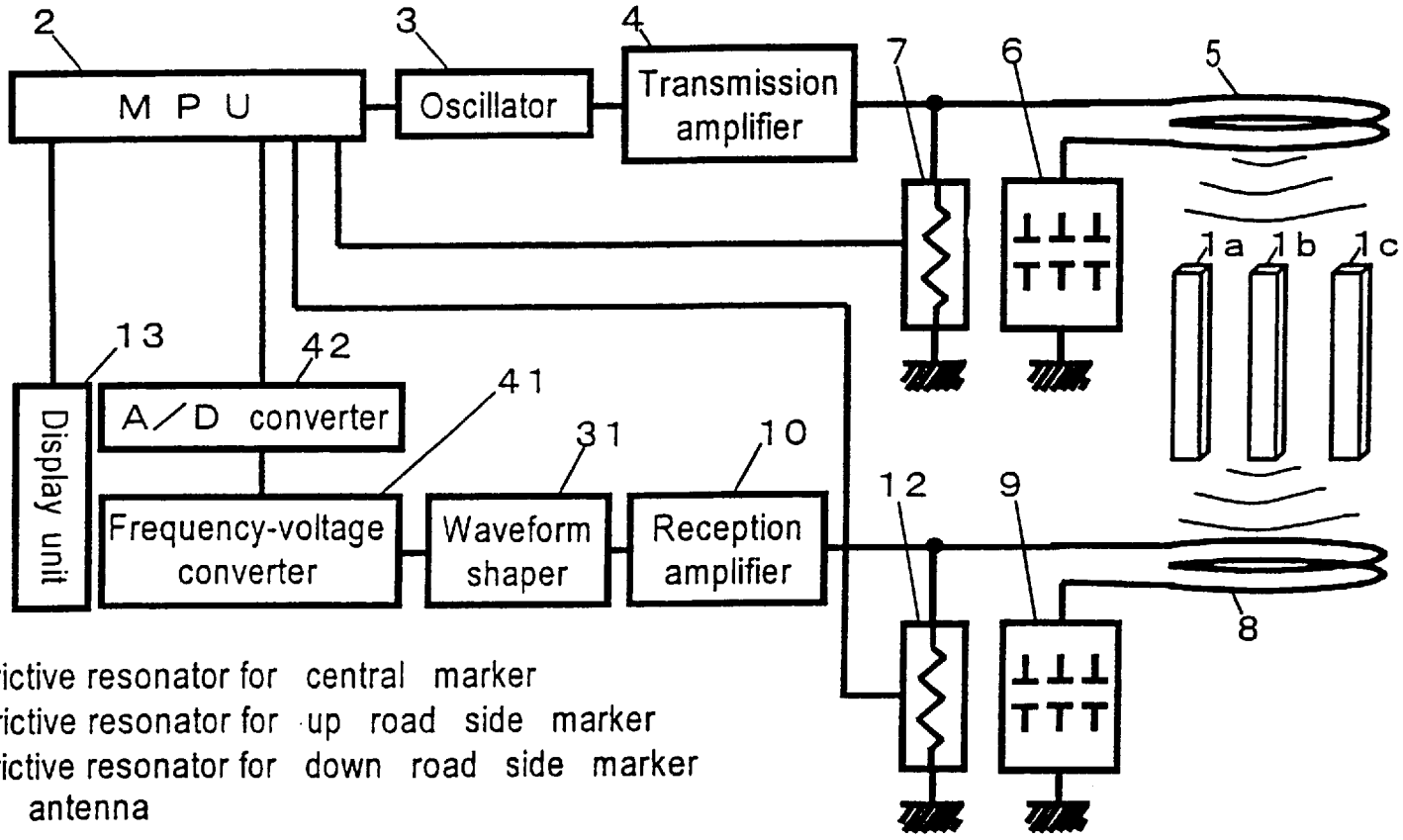
FIG. 6 is a block diagram of third signal processing of reception section of the same magnetostrictive resonator detection apparatus.

FIG. 6 is a block diagram of MRDA showing a third specific constitution of the signal converter 11 shown in FIG. 3. In FIG. 6, same constituent parts as in the first, second and third embodiments are identified with same reference numerals and duplicate explanation is omitted. Reference numeral 41 is a frequency-voltage converter which converts the reception signal of the waveform shaper 31 from frequency to voltage. Reference numeral 42 is an A/D converter which takes the voltage value converted in the frequency-voltage converter 41 into the MPU 2 as digital value.

In this constitution, as the voltage value, the resonance frequency of, for example, the magnetostrictive resonator 1*a* is detected.

The MRDA in the embodiment of the invention is described below while referring to the drawings.

Incidentally, the resonance frequency of the magnetostrictive resonators 1*a*, 1*b*, 1*c* can be set at every 30 kHz approximately from 90 kHz, and it can be selected up to 445 kHz of the commercial medium wave broadcast. In this embodiment, for example, the magnetostrictive resonator 1*a* for the central marker is buried at resonance frequency of f1=210 kHz, the magnetostrictive resonator 1*b* for up road side marker at resonance frequency of f2=240 kHz, and the magnetostrictive resonator 1*c* for down road side marker at resonance frequency of f3=270 kHz.

The operation of the MRDA mounted aboard the vehicle 15 in the embodiment of the invention shown in FIG. 3 is as follows.

The MPU 2 causes the oscillator 3 to oscillate f1 which is the resonance frequency of the magnetostrictive resonator 1*a* for central marker, amplifies the electric power in the transmission amplifier 6, and sends out from the transmitting antenna 5. At this time, at the return terminal of the transmitting antenna 5, the capacitor most suited to the frequency to be transmitted in the transmission tuning capacitor unit 6 (f1 in this case) is selected and connected in series. At the same time, the MPU 2 makes the discharge resistance 7 inactive, and the discharge resistance 12 active.

Thus, the electromagnetic wave is transmitted to the magnetostrictive resonator 1*a* for central marker, and it is set in resonant state if within the resonant range. Then reception starts, and at this time, for a short period, the discharge resistance 7 is set in active state and the distance resistance 12 in inactive state. At the same time, at the return terminal of the receiving antenna 8, the capacitor most suited to the frequency to be received in the reception tuning capacitor unit 9 (f1 in this case) is selected and connected in series. When changing from transmission to reception, since the discharge resistance for transmission 7 is activated, the reception impedance by echo of transmission output can be prevented.

Besides, by activating the discharge resistance 12 of the reception section during transmission of electromagnetic wave through the transmitting antenna 5 from the transmission frequency output unit composed of oscillator 3, transmission amplifier 4 and others, the reception section composed of reception amplifier 10, signal converter unit 12 and others is inactivated to be in waiting state, and therefore the reception section does not receive the transmitted electromagnetic wave to be saturated, and therefore after changing over from transmission to reception, it is ready to receive immediately, so that the presence of the magnetostrictive resonator 1*a* can be detected securely in reception mode.

The echo signal of electromagnetic wave by resonance of the magnetostrictive resonator 1*a* for central marker is put into the reception amplifier 10 from the receiving antenna 8 and is amplified. At this time, in the reception tuning capacitor 9, the capacitor most suited to the frequency to be transmitted (f1 in this case) is selected and connected in series. This echo signal is converted by the signal converter 11, and is taken into the MPU 2.

In this case, since the frequency of the transmitted electromagnetic wave coincides with the resonance frequency of the magnetostrictive resonator 1*a* for central marker, the magnetostrictive resonator 1*b* for up road side marker or magnetostrictive resonator 1*c* for down road side marker does not radiate electromagnetic wave by vibration of magnetostrictive resonator. The receiving antenna 8 and the reception tuning capacitor 9 do not receive because their frequency does not coincide with the frequency of the electromagnetic wave radiated by the magnetostrictive resonator 1*b* for up road side marker or magnetostrictive resonator 1*c* for down road side marker.

After completion of transmission (transmission frequency f1) to the magnetostrictive resonator 1*a* for central marker and its reception, the electromagnetic wave at frequency corresponding to the resonance frequency of, for example, magnetostrictive resonator 1*b* for up road side marker (for example, transmission frequency f2) is transmitted and received. Then, the electromagnetic wave at frequency corresponding to the resonance frequency of magnetostrictive resonator 1*c* for down road side marker (for example, transmission frequency f3) is transmitted and received. Of course, f1, f2, and f3 are mutually different frequencies.

Figure 7:
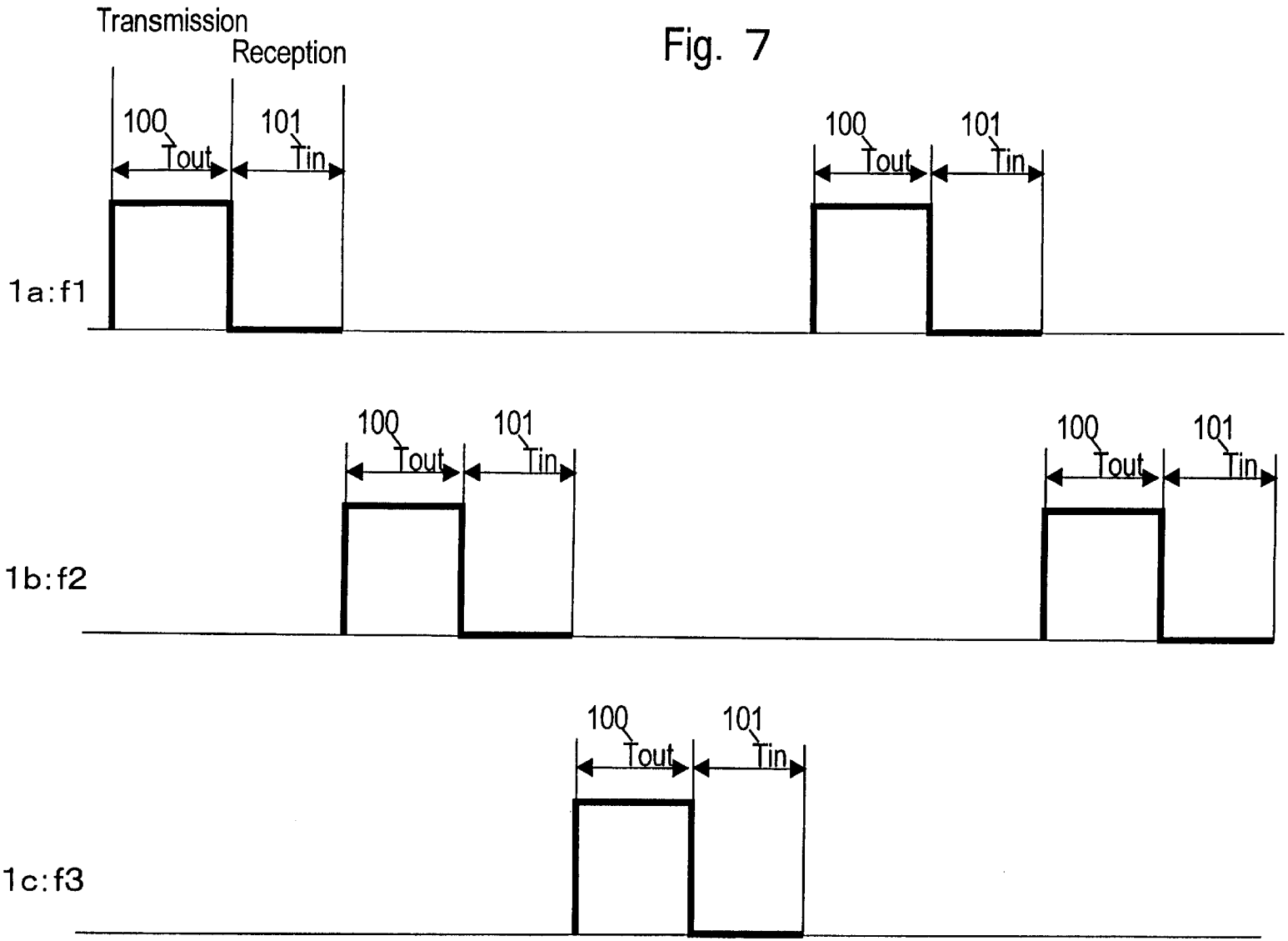
FIG. 7 is a diagram showing transmission and reception timing in plural magnetostrictive resonators.

FIG. 7 shows the timing of sequential and cyclic transmission and reception of the magnetostrictive resonator 1*a* for central marker followed by the magnetostrictive resonator 1*b* for up road side marker and the resonance frequency of magnetostrictive resonator 1*c* for down road side marker. By this operation, the position on the road is judged. At this time, the selection of the oscillator 3, transmission tuning capacitor 6 and reception tuning capacitor 9 is done by the same rule as mentioned above.

In this way, by selectively transmitting the electromagnetic waves to the magnetostrictive resonators 1*a*, 1*b*, 1*c* for each marker for a short time, transmission at each frequency is terminated by activating the transmission discharge resistance 7 (passing bleeder current). The transmitting antenna 5 is provided with a tuning circuit at each resonance frequency (transmission tuning capacitor unit 6). When receiving, the receiving antenna 8 is provided with a tuning circuit at each resonance frequency (reception tuning capacitor unit 9), and the vibration echo of each magnetostrictive resonator for each marker in the resonant range is distinguished efficiently.

The operation of the MRDA in the embodiment according to the constitution in FIG. 4 is intended to detect the magnetostrictive resonator by amplifying the electromagnetic wave radiated from the magnetostrictive resonator, for example, 1*a* entered in the receiving antenna 8 in the embodiment of the invention shown in FIG. 3 explained above by the reception amplifier 10, measuring the logic signal level frequency of the amplified output in the frequency measuring unit 21, and taking into the MPU 2. This operation is same as the operation of the invention explained in FIG. 3.

The operation of the MRDA in the embodiment according to the constitution in FIG. 5 is intended to detect the magnetostrictive resonator by amplifying the electromagnetic wave radiated from the magnetostrictive resonator, for example, 1*a* entered in the receiving antenna 8 in the embodiment of the invention shown in FIG. 3 explained above by the reception amplifier 10, shaping the waveform of the amplified output into a rectangular waveform in the waveform shaper 31, counting the number of signals of rectangular waveform in the counter 32, and taking into the MPU 2. This operation is same as the operation of the invention explained in FIG. 3.

The operation of the MRDA in the embodiment according to the constitution in FIG. 6 is intended to detect the magnetostrictive resonator by amplifying the electromagnetic wave radiated from the magnetostrictive resonator, for example, 1*a* entered in the receiving antenna 8 in the embodiment of the invention shown in FIG. 3 explained above by the reception amplifier 10, shaping the waveform of the amplified output into a rectangular waveform in the waveform shaper 31, converting its waveform into a voltage in the frequency-voltage converter 41, converting the signal converted into voltage into a digital value in the A/D converter 42, and taking into the MPU 2. This operation is same as the operation of the invention explained in FIG. 3.

As clear from the description herein, the MRDA in the embodiments of the invention shown in FIG. 3, FIG. 4, FIG. 5 and FIG. 6 is capable of detecting the presence of the magnetostrictive resonator by transmitting the electromagnetic waves to the magnetostrictive resonator for inducing intrinsic mechanical resonance to excite the magnetostrictive resonator into a resonant state, and measuring the resonance frequency in this state. Since it is not particularly necessary to know the phase difference from the transmitted electromagnetic wave, it is a feature that the magnetostrictive resonator can be identified without using the transmission signal. Moreover, the magnetostrictive resonator can be detected without having effects of the transmitted electromagnetic wave. In addition, plural magnetostrictive resonators can be distinguished efficiently.

Therefore, by mounting the MRDA in the embodiments of the invention shown in FIG. 3, FIG. 4, FIG. 5 and FIG. 6 aboard the vehicle 15, the magnetostrictive resonators 1*a*, 1*b*, 1*c* for each marker buried in the road 14 can be detected in real time without making contact, and moreover by detection of up or down marker or detection of central marker, the road information can be adequately transmitted to the vehicle on the road, so that the position can be judged correctly regardless of weather condition or nighttime condition, which brings about tremendous benefits to safety of road traffic system, automatic driving and other driving of vehicles.

Figure 8:
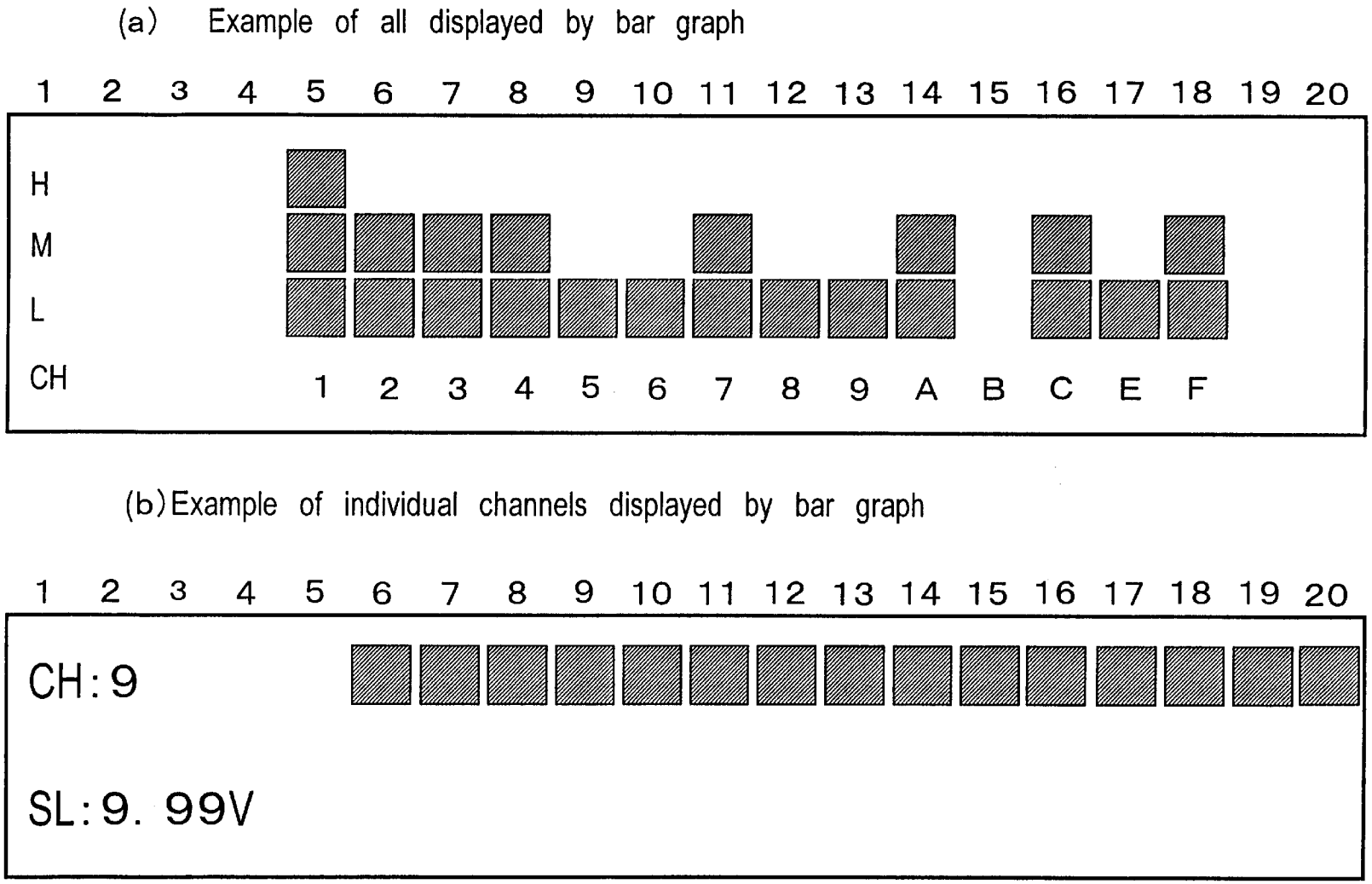
FIG. 8A is a first diagram showing an example of bar graph display of detection level of magnetostrictive resonator in the same apparatus.
FIG. 8B is a second diagram thereof.

In the MRDA in the embodiments of the invention shown in FIG. 3, FIG. 4, FIG. 5 and FIG. 6, meanwhile, the display unit 13 identifies the magnetostrictive resonator, and also displays its detection level, for example, by a bar graph as shown in FIG. 8. In the display shown in FIG. 8, it is easier to see the detection level of each magnetostrictive resonator.

Figure 9:
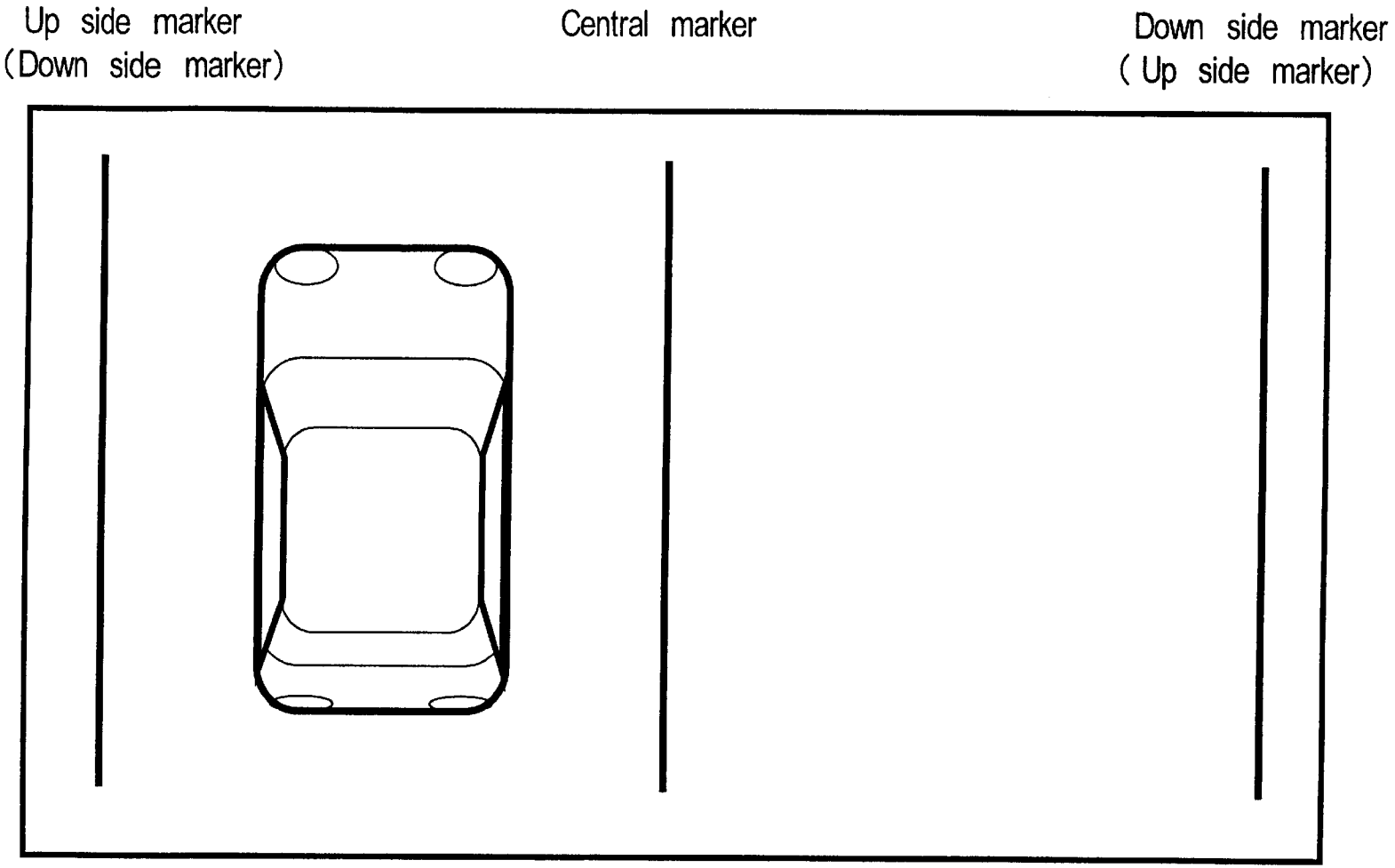
FIG. 9 is a diagram showing an example of display of configuration of road and vehicle in the same apparatus.

Incidentally, the display unit 13 may also display the vehicle position on the road as shown in FIG. 9, aside from displaying the road and vehicle.

Thus, according to the invention, by transmitting the electromagnetic waves of specified resonance frequencies to the magnetostrictive resonator 1*a* for central marker, magnetostrictive resonator 1*b* for up road side marker, and magnetostrictive resonator 1*c* for down road side marker buried in the road 14, sequentially from the transmitting antenna 5 attached to the vehicle 15, when the magnetostrictive resonators 1*a*, 1*b*, 1*c* for each marker are in the range for receiving the electromagnetic waves to be set in resonant state, the electromagnetic echo in the resonant state of the magnetostrictive resonators 1*a*, 1*b*, 1*c* is entered from the receiving antenna 8, amplified and detected, and the configuration of the vehicle 15 and road 14 is judged.

Therefore, by mounting the MRDA of the embodiment of the invention aboard the vehicle 15, the magnetostrictive resonators 1*a*, 1*b*, 1*c* for each marker buried in the road 14 can be detected in real time without making contact, and moreover by detection of up or down marker or detection of central marker, the road information can be adequately transmitted to the vehicle on the road, so that the position can be judged correctly regardless of weather condition or nighttime condition, which brings about tremendous benefits to safety of driving of vehicles.

It is further useful for supporting automatic traveling of vehicles when the social infrastructure is prepared.

Incidentally, the configuration of the magnetostrictive resonators 1*a*, 1*b*, 1*c* for each marker buried in the road 20 may be proved near the road shoulder only in a narrow road, or, to the contrary, in a wide road having plural lanes on each side, the magnetostrictive resonators may be added between each lane. Instead of the boundaries of lanes, magnetostrictive resonators may be installed in the middle of each lane, too.

The detecting sequence of magnetostrictive resonators (oscillation sequence of resonant frequencies) is not limited to the illustrated embodiments of the invention alone, but various other sequences are considered, such as the sequence of magnetostrictive resonator 1*a* for central marker, magnetostrictive resonator 1*b* for up road side marker, magnetostrictive resonator 1*a* for central marker, and magnetostrictive resonator 1*c* for down road side marker. In the case of multiple lanes, magnetostrictive resonators may be added according to the lanes.

Figure 10:
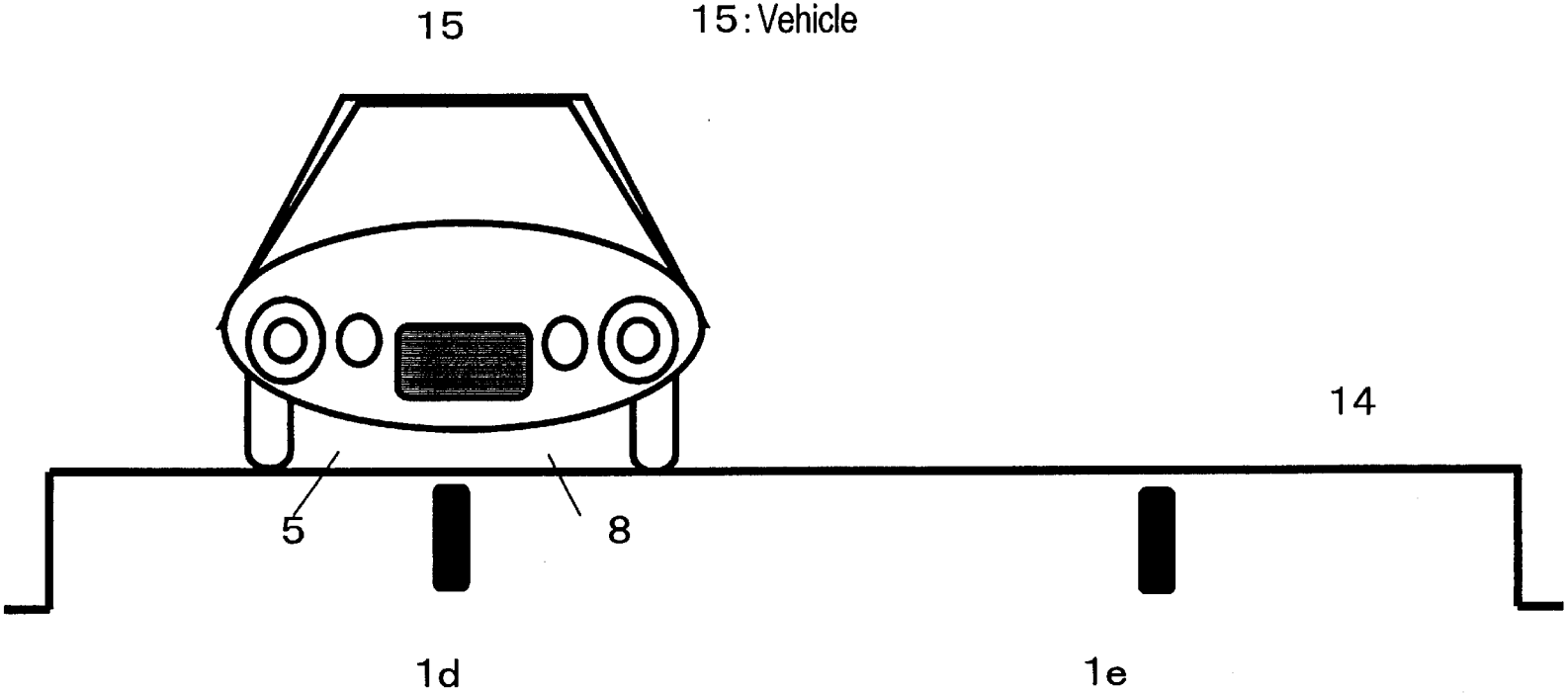
FIG. 10 is a diagram showing an example of installation of magnetostrictive resonator in the middle of a lane of a road in the same apparatus.

Further, as shown in FIG. 10, by disposing the magnetostrictive resonator 1*d* for up lane of the road 14 in the middle of the up lane and the magnetostrictive resonator for down lane in the middle of the down lane, they may be detected by the MRDA mounted aboard the vehicle 15 to drive automatically, or plural pieces of information may be incorporated in one magnetostrictive resonator. Moreover, plural magnetostrictive resonators may be combined to present road information.

In the embodiment, two antennas are used for transmission and reception, but the transmitting antenna and receiving antenna may be used commonly, or each antenna may be provided in a plurality.

As described herein, according to the first traffic system of the invention, the road 14 comprises plural magnetostrictive resonators, and the vehicle 15 has the MRDA of the invention, so that a safe traveling system of vehicle 15 is presented.

In the second traffic system of the invention, since magnetostrictive resonators having road information assigned with mutually different resonance frequencies (for example, magnetostrictive resonators 1*a*, 1*b*, 1*c* shown in FIG. 2) are buried in the road 14 continuously at specified intervals at each resonance frequency, a continuous safe and secure traveling system may be presented.

In the third traffic system of the invention, as shown in FIG. 10, since the vehicle 15 travels automatically by detecting, for example, the magnetostrictive resonator 1*d*, a safe and secure traffic system suited to the senile society may be presented.

In the fourth traffic system of the invention, since the magnetostrictive resonator is buried in the road 14, the durability of the magnetostrictive resonator is enhanced.

In the fifth traffic system of the invention, as shown in FIG. 9, the position of the vehicle 15 on the road 14 may be easily and securely detected.

What is claimed is:

1. A detecting method for a magnetostrictive resonator, comprising the steps of:

a) inactivating a reception section while transmitting an electromagnetic wave at a frequency for generating an intrinsic mechanical resonance to the magnetostrictive resonator, b) activating the reception section after stopping transmission of said electromagnetic wave, and c) detecting the electromagnetic wave radiated by said magnetostrictive resonator resonating mechanically.

2. A magnetostrictive resonator detection apparatus comprising:

a transmission section for transmitting an electromagnetic wave at a frequency for generating an intrinsic mechanical resonance to a magnetostrictive resonator, and a reception section having a function of making said reception section inactive while said transmission section is transmitting the electromagnetic wave, and for detecting the electromagnetic wave radiated by said magnetostrictive resonator resonating mechanically after said transmission of said electromagnetic wave is stopped.

3. A magnetostrictive resonator detection apparatus of claim 2, wherein the reception section comprises a signal processor for measuring the frequency of the electromagnetic wave radiated from the magnetostrictive resonator.

4. A magnetostrictive resonator detection apparatus of claim 2, wherein the reception section comprises a waveform shaper and a counter, and the frequency is measured by counting the number of cycles of the electromagnetic waves radiated by the magnetostrictive resonator in each unit time.

5. A magnetostrictive resonator detection apparatus of claim 2, wherein the reception section comprises a waveform shaper and a frequency-voltage converter, and the electromagnetic wave radiated by the magnetostrictive resonator in unit time is converted from frequency to voltage, and is measured.

6. A magnetostrictive resonator detection apparatus of any one of claims 2 to 5, wherein a discharge resistance is connected between the transmission frequency output unit and the antenna for transmitting electromagnetic wave in the air, and the discharge resistance is activated when changing over from transmission to reception.

7. A magnetostrictive resonator detection apparatus of any one of claims 2 to 5, wherein the transmission section comprises an oscillator for transmitting electromagnetic waves of plural frequencies, and a reception section for receiving plural frequencies corresponding to the frequencies transmitted from the transmission section.

8. A magnetostrictive resonator detection apparatus of any one of claims 2 to 5, wherein the transmission section comprises a capacitor for tuning at every one of plural different resonance frequencies and a function for selecting said capacitor according to the oscillated resonance frequency, and the reception section comprises a capacitor tuning at every one of plural different frequencies transmitted from the transmission section and a function for selecting the capacitor according to the received resonance frequency.

9. A magnetostrictive resonator detection apparatus of any one of claims 2 to 5, wherein after transmission and reception of electromagnetic wave of one resonance frequency out of plural different resonance frequencies, the electromagnetic wave of a different resonance frequency from said one resonance frequency is transmitted and received.

10. A magnetostrictive resonator detection apparatus of any one of claims 2 to 5, further comprising a display unit for specifying the magnetostrictive resonator, and displaying its detection level by a bar graph.

11. A magnetostrictive resonator detection apparatus of any one of claims 2 to 5, wherein a magnetostrictive resonator detection apparatus is affixed to a vehicle.

12. A magnetostrictive resonator detection apparatus of claim 11, wherein magnetostrictive resonators having road information assigning mutually different resonance frequencies are continuously buried in a road at specific intervals at each resonance frequency.

13. A magnetostrictive resonator detection apparatus of claim 11, wherein the vehicle travels automatically by detecting the magnetostrictive resonators.

14. A magnetostrictive resonator detection apparatus of claim 11, wherein magnetostrictive resonators are buried in a road.

15. A magnetostrictive resonator detection apparatus of claim 14, further comprising a display unit for displaying the road and vehicle information, wherein the vehicle position on the road is displayed.

16. A magnetostrictive resonator detection apparatus of claim 12, wherein the vehicle travels automatically by detecting the magnetostrictive resonators.

17. A magnetostrictive resonator detection apparatus of claim 12, further comprising a display unit for displaying the road and vehicle information, wherein the vehicle position on the road is displayed.

18. A magnetostrictive resonator detection apparatus of claim 13, further comprising a display unit for displaying the road and vehicle information, wherein the vehicle position on the road is displayed.

19. A magnetostrictive resonator detection apparatus of claim 12, wherein magnetostrictive resonators are buried in a road.

20. A magnetostrictive resonator detection apparatus of claim 13, wherein magnetostrictive resonators are buried in a road.

21. A magnetostrictive resonator detection apparatus of claim 11, further comprising a display unit for displaying the road and vehicle information, wherein the vehicle position on the road is displayed.

* * * * *